US008479940B2

(12) United States Patent
Marra et al.

(10) Patent No.: US 8,479,940 B2
(45) Date of Patent: Jul. 9, 2013

(54) PACKAGING COMBINATION, CONTAINER, CASING AND LID

(75) Inventors: Fernanda Marra, Vila Mariana (BR); Paula Renata Martins, Vila Madalena (BR)

(73) Assignee: Natura Cosmeticos S.A., Itapecerica de Serra SP (BR)

( * ) Notice: Subject to any disclaimer, the term of this patent is extended or adjusted under 35 U.S.C. 154(b) by 802 days.

(21) Appl. No.: 11/948,165

(22) Filed: Nov. 30, 2007

(65) Prior Publication Data

US 2008/0230540 A1 Sep. 25, 2008

(30) Foreign Application Priority Data

Dec. 5, 2006 (BR) ..... PI0605340-8

(51) Int. Cl.
*B65D 21/02* (2006.01)

(52) U.S. Cl.
USPC ..... 220/23.87; 220/23.89

(58) Field of Classification Search
USPC ..... 220/23.87, 23.89, 255, 256.1, 23.91; 215/334, 330, 331
See application file for complete search history.

(56) References Cited

U.S. PATENT DOCUMENTS

| | | | | |
|---|---|---|---|---|
| 3,249,248 | A * | 5/1966 | Metzendorf et al. | 215/334 |
| 4,597,501 | A * | 7/1986 | Gueret | 215/330 |
| 5,099,998 | A | 3/1992 | Curzon et al. | |
| 5,826,741 | A * | 10/1998 | Dumler et al. | 215/321 |
| 6,945,419 | B2 * | 9/2005 | Bertazza et al. | 220/23.87 |
| 7,621,411 | B2 * | 11/2009 | Doherty et al. | 215/228 |

FOREIGN PATENT DOCUMENTS

| | | |
|---|---|---|
| EP | 0 661 012 | 7/1995 |

* cited by examiner

*Primary Examiner* — Mickey Yu
*Assistant Examiner* — Chun Cheung
(74) *Attorney, Agent, or Firm* — Alston & Bird LLP

(57) ABSTRACT

A packaging combination characterized by including a casing (1) having at least two openings (5, 6), and a casing coupler; a container (2) having a mouth (11), a container coupler and a container attachment mechanism, wherein the container (2) is at least partially housed inside the casing (1) and its container coupler cooperate at least partially with the casing coupler; a sealing lid (4) having sealing lid attachment structure, wherein the sealing lid (4) can be fastened to the container (2), with the lid attachment structure cooperating with the container attachment mechanism.

16 Claims, 5 Drawing Sheets

PACKAGING COMBINATION, CONTAINER, CASING AND LID

BACKGROUND OF THE INVENTION

The present invention refers to a packaging combination comprised of multiple different parts that are easily joined together, wherein at least one of said parts acts as an exchangeable refill for the product carried inside the packaging.

Nowadays, manufacturers of cosmetic and hygiene products are concerned with commercializing their products in packaging that is attractive, resistant and at the same time practical, in order to give added value to their products and to make them stand out from competition and ultimately to increase sales.

However, in general terms more attractive and more resistant packaging tends to be considerably more costly, which ultimately weighs on the end price of the traded product. Additionally, such packaging normally consumes a higher quantity of non-biodegradable materials, which are significantly harmful to the environment when disposed.

In order to overcome these problems, it is a common practice to use packaging comprised of various different parts that can be joined together, of which at least one acts as an exchangeable refill wherein the product is effectively stored, whereas other packaging components can be reused. Accordingly, when the entire quantity of the product contained within the packaging is consumed, the user can acquire a product refill that is then connected to the other re-usable parts of the packaging.

This practice enables a cost reduction for the commercialized product, since it is carried in a simpler and thus less costly packaging. Therefore, the complete packaging combination, comprising the refill and the re-usable components, is only acquired once, thus avoiding wastage of certain parts.

This procedure also allows re-usable packaging components to be of a higher quality, more resistant and more attractive and, therefore, more expensive than packaging that is entirely disposable, since the costs relating to the re-usable components of the packaging combination need only be afforded a few times.

Additionally, the reduction in the quantity of disposable parts of the packaging contributes to reducing the wasted material when the packaging is disposed of and, consequently, to promoting environmental conservation, which is a fundamentally important aspect for modern industry.

Another important aspect concerning hygiene and beauty products is that some such products may have a rather viscous and dense consistency and, therefore, flow slowly inside the packaging, such as paste-base products, cosmetic creams or moisturizers, shampoos and hair conditioners. In this regard, it is desirable for these products to be stored in packaging that can remain head downwards so that the contents may be extracted with greater ease and speed from inside the packaging when being used.

In order to accommodate and commercialize products, certain packagings comprised of various parts that can be joined together are already known in the state of the art. One such part is a refill component for the product, which can be disposable.

U.S. Pat. No. 5,099,998 discloses a container comprising an inner container that is housed within an outer container. The two parts fit together by passing the flask through the mouth of the container in such a way that the flask is supported on the upper rim of the container. This packaging also has a sealing lid, which is frictionally encased into the mouth of the inner flask, and an additional lid for the whole packaging combination, which is fixed directly onto the outer container.

One of the disadvantages is that if this packaging is turned sideways or head downwards, the product will be spilled, because the connection of the inner flask to the sealing lid and to the outer container is not sufficiently seal-tight to avoid product leakage. Thus, the flask would detach from the container and the sealing lid would come off the flask, causing product spillage. Additionally, the sealing lid used in this packaging is not sufficiently resistant or seal-tight to enable the product simply to be commercialized inside the inner flask topped by the sealing lid.

EP 0661012 refers to a case for cream comprising an outer container that can be closed by a lid and by an exchangeable insert that is housed within the case and where the preparation is stored. The outer case and inner container are connected to one another by catch elements engaging one another in a clippable manner, when the container is inserted through the mouth of the case to be housed therein, in such a manner that the container rests on the upper rim of the outer container. The outer case also has a flexible base to support the bottom of the container.

The disadvantage of this packaging again is that it is incapable of preventing product spillage if turned head downwards. Additionally, the lid used in this packaging is fixed only to the outer container. There are no suggestions for directly sealing the inner container that would enable it to be commercialized separately from the outer container.

The packaging disclosed in document MU 7201057-6 comprises a lid, a refill cup, and a body connected to one another. In its upper section, the refill cup has a fitting that perfectly adapts to the existing fitting in the upper section of the body, in such a way that these two parts are connected and locked by joining their locks and counterlocks.

The disadvantage of this packaging is that it has no specific sealing for the refill cup that would enable it to be commercialized separately from the other packaging components.

Additionally, since the refill cup is inserted through the body mouth, which has a smaller diameter than the diameter of the rest of the body, the cup has to have a smaller diameter than the opening of the body mouth so it can pass through the fitting. Therefore, the internal volume of the body corresponding to the difference between its diameter and the diameter of the cup is not occupied by the cup and is ultimately empty. Hence, the internal volume of the body is not utilized to house the product in an optimal manner.

It is therefore notable that none of these documents suggest packagings having refills that can be commercialized separately from the re-usable parts, because the refills are not sealed to guarantee their seal-tightness.

Nor do the documents of the state of the art provide packagings that can be turned head downwards and remain thus for a long period of time while preventing product leakage.

Another disadvantage of the packagings of the state of the art is that the inner space of the outer container that accommodates the refill is not wholly utilized for product storage, since the size of the refill must necessarily be smaller than the outer container so that it can pass through the container's mouth and be fitted inside.

BRIEF SUMMARY OF THE DISCLOSURE

The present invention in at least some embodiments is designed to provide a packaging combination having a disposable refill that can remain in a head-down position for a long period of time without its contents spilling out from inside.

An embodiment of the present invention comprises a refill used in the packaging combination that is sealed by an additional lid other than that used to secure the entire packaging combination.

Another objective of the packaging combination in accordance with some embodiments of the present invention is to provide a refill that is capable of occupying the maximum possible space within the packaging combination, to allow a greater quantity of the product to be housed inside it.

The present invention in some embodiments also aims to provide a packaging combination that solves the problems of the state of the art and at the same time is easy to handle.

The present invention in one embodiment is able to overcome the disadvantages mentioned previously by way of a packaging combination comprising a casing having at least two openings, and a casing coupler; a container having a mouth, a container coupler, and a container attachment mechanism, wherein the container is at least partially housed inside the casing and its container coupler cooperates at least partially with the casing coupler; and a sealing lid having sealing lid attachment structure, wherein the sealing lid can be attached to the container, with the lid attachment structure cooperating with the container attachment mechanism.

In the packaging combination according to an embodiment of the invention, one opening of the casing constitutes a mouth of the casing and another opening of the casing constitutes a passage for inserting the container, to the extent that the cross section of the container can be bigger than the mouth opening of the casing.

The casing coupler is located on the inner surface of the casing, while the container attachment mechanism and the container coupler is located on the outer surface of the container, and the container coupler is below the container attachment mechanism.

The present invention in some embodiments also refers to a refill-type container comprising a mouth, a container attachment mechanism located on its outer surface and a container coupler located on its outer surface, below the container attachment mechanism, wherein the container coupler is designed to connect to an outer casing of the packaging, and the container attachment mechanism is designed to connect to a sealing lid.

Another purpose of some embodiments of the present invention is to provide a packaging casing having at least two openings. One of the openings of the casing constitutes a casing mouth and another opening of the casing constitutes a passage for inserting the refill-type container, the casing also comprising a casing coupler adapted to retain a refill-type container.

The present invention in some embodiments also particularly relates to a sealing lid that is adapted to connect to a packaging combination of the present invention. This lid may comprise fitting structure designed to connect to an outer lid, and apportioning structure for the contents of the container.

BRIEF DESCRIPTION OF THE DRAWINGS

The present invention is described in greater detail below based on an embodiment presented in the drawings. The drawings show.

DETAILED DESCRIPTION OF THE DRAWINGS

Figure 1:
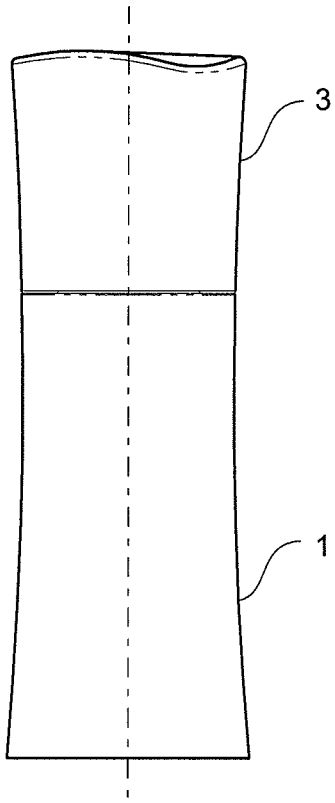
FIG. 1—front view of a preferred embodiment of the packaging combination according to this present invention.
Figure 2:
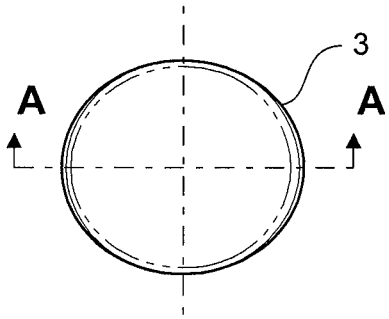
FIG. 2—upper view of this present invention.

FIGS. 1 and 2 illustrate a preferred embodiment of the packaging combination according to this present invention, in an assembled state. As can be seen more clearly in FIG. 3 which illustrates a longitudinal section of the packaging combination according to this present invention, this packaging combination is comprised of four separate parts, namely, a casing 1, a container 2 that is fitted inside the casing 1, an outer lid 3, and a sealing lid 4 that is fitted inside the outer lid 3 and is directly fastened to the container 2.

As can be seen in greater detail in FIGS. 4 to 7 specifically showing a preferred embodiment of casing 1, this part of the packaging combination is hollow and has an essentially tubular format. In alternative embodiments of the invention, the casing 1 may be polygon or sphere shaped, or for example, in the shape of an animal or fruit, or even any other desired shape.

The casing 1 has an opening 5 at its lower end and an opening 6 at its upper end that constitutes the casing mouth. The casing mouth 6 has a smaller diameter than that of the lower opening 5. The casing has a casing coupler arranged on the inner surface of its upper end, which allows it to be detachably but securely coupled to the container of the packaging combination.

According to the embodiment illustrated in FIGS. 4 to 7, the casing coupler is comprised by an upper portion 9 of the inner surface of the casing having a diameter equal in size to the mouth 6, followed by an intermediate portion 7 of the inner surface of the casing, with a slightly smaller diameter than that of the upper portion 9, and followed by a lower portion 21 of the inner surface of the conical section casing whose diameter expands downwards. The casing coupler also comprises two vertical slots 8 that leave the mouth 6, traverse the upper portion 9 and the intermediate portion 7 and extend to the lower end of the lower portion 21 of the inner surface of the casing. These slots 8 are located diametrically opposite each other.

In alternative embodiments of the invention, the casing coupler may be comprised of screw members, fastening elements, pressure fastening members, lock fastening elements due to shape, or friction fastening elements, or any combination of these elements.

FIGS. 8 to 11 illustrate a preferred embodiment of container 2 of the packaging combination. This container 2 is substantially tubular shaped, having a smaller diameter than the inner diameter of the casing, but larger than the diameter of the casing mouth 6. In alternative embodiments of the present invention, the container 2 may be polygon or sphere shaped, or any other desired shape, provided that the container 2 is at least partially housed inside the casing 1. At its upper end, the container 2 has a neck 10 with a smaller diameter than the diameter of its body and ending in a mouth 11. The mouth of the container must be able to traverse the casing mouth 6.

The neck 10 of the container has a container attachment mechanism located on its outer surface that serves to fasten the container to the sealing lid 4 of the packaging combination in a seal-tight manner. In a particular embodiment of the invention illustrated in FIGS. 5 and 6, the attachment mechanism comprises a thread 12, so that the lid can be screwed to the neck 10 of the container.

In other alternative embodiments of the invention, the container attachment mechanism may be constituted in the form of fastening elements, pressure fastening members, or by lock due to shape, or by friction, or any combination thereof that can suitably seal the container.

The container also has a container coupler that serves to couple the container detachably but securely to the casing of the packaging combination. The container coupler is preferably at least partially corresponding to the casing coupler.

Figure 8:
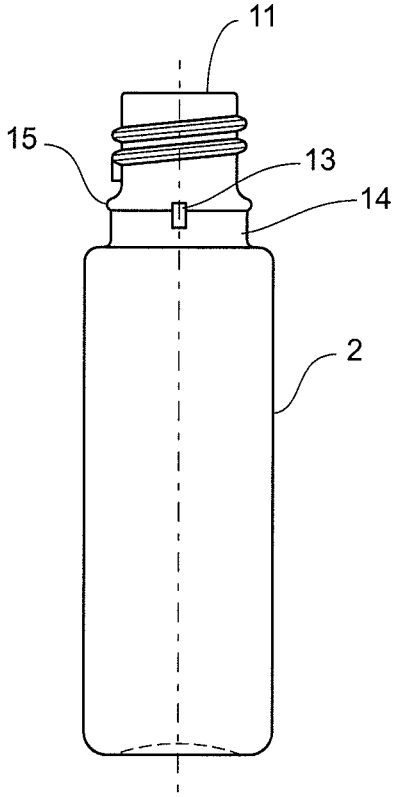
FIG. 8—side view of the container of the packaging combination of this present invention.
Figure 9:
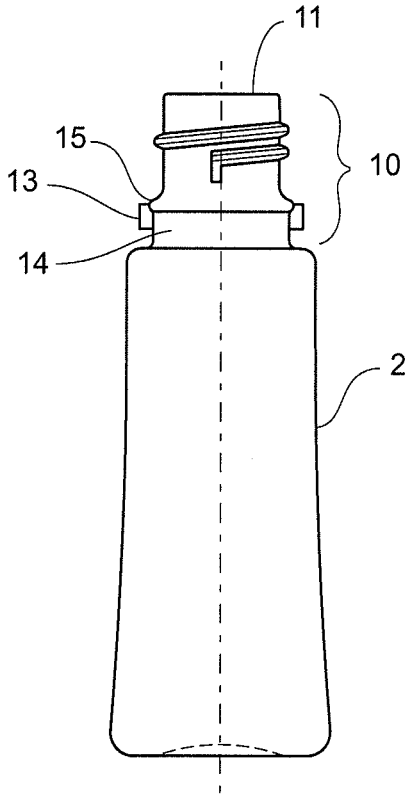
FIG. 9—front view of the container of the packaging combination of this present invention.
Figure 10:
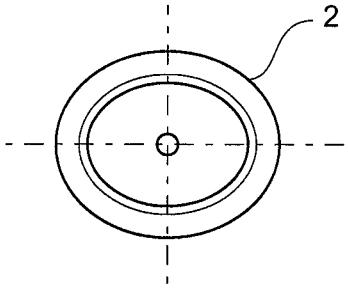
FIG. 10—bottom view of the container of the packaging combination of this present invention.
Figure 11:
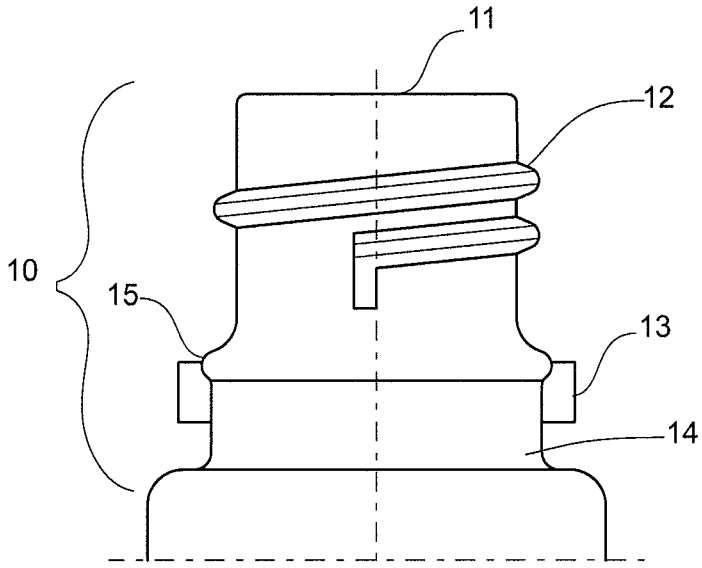
FIG. 11—detailed view of the neck of the container of the packaging combination of this present invention.

In a preferred embodiment of the container of the packaging combination illustrated in FIGS. 8, 9 and 11, the container coupler is located on the outer surface of the neck 10 of the container, below the attachment mechanism in the form of a thread 12. The container coupler of the container is comprised of a first portion 15 of the outer surface of the container having a greater outer diameter than the diameter of the mouth 11, followed by a second portion 14 of the outer surface of the container, having a slightly smaller diameter than that of the first 15 and also smaller than the diameter of the body of the container. The container coupler also comprises two vertical protrusions 13 which extend from the first portion 15 of the outer surface of the container to the second portion 14 of the inner surface of the casing. These protrusions 13 are located diametrically opposite each other.

Accordingly, when the container is fitted inside the casing, the first portion 15 of the outer surface of the container connects with the upper portion 9 of the inner surface of the casing, the second portion 14 of the outer surface of the container connects to the intermediate portion 7 of the inner surface of the casing and the protrusions 13 of the container fit into the casing slots 8. Thus, the container can only be inserted into the casing in a certain position, wherein the protrusions 13 of the container connect with the casing slots 8. This also prevents the container from rotating about its axis inside the casing.

Since the first portion 15 of the outer surface of the container and the upper portion 9 of the inner surface of the casing have a greater diameter than the second portion 14 of the outer surface of the container and the intermediate portion 7 of the inner surface of the casing, this prevents the container from unfastening and rotating inside the casing 1.

Additionally, since the body of the container 2 is wider than the opening of the casing mouth 6, then the packaging combination can be kept head downwards without the container detaching from the casing.

In alternative embodiments of the invention, the container coupler can be in the form of screw members, or fastening elements, pressure fastening members, lock fastening elements due to shape, or friction fastening elements, or any combination of these elements.

Figure 3:
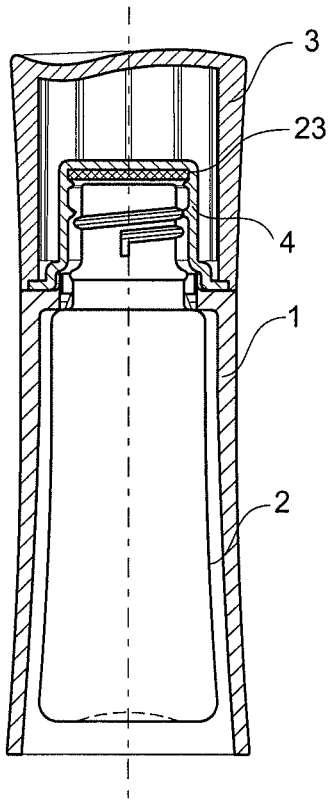
FIG. 3—cross section view of the packaging combination corresponding to section A-A shown in FIG. 2.
Figure 4:
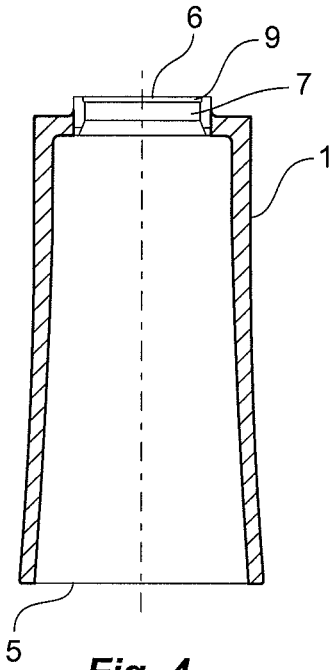
FIG. 4—cross section view of the casing of the packaging combination corresponding to section A-A shown in FIG. 6.
Figure 5:
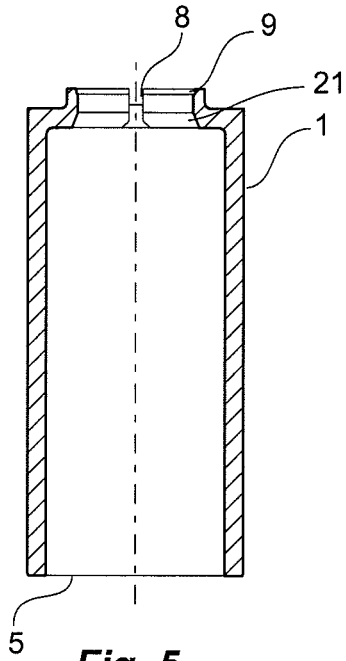
FIG. 5—cross section view of the casing of the packaging combination corresponding to section B-B shown in FIG. 6.
Figure 6:
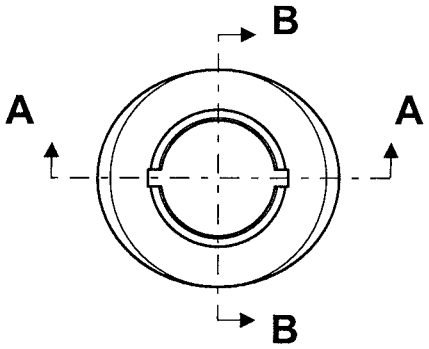
FIG. 6—top view of the casing of the packaging combination of this present invention.
Figure 7:
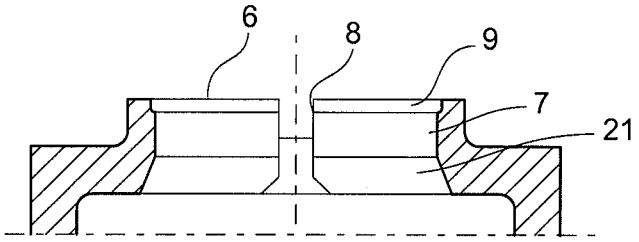
FIG. 7—detailed view of the upper end of the casing of the packaging combination of this present invention.

FIGS. 2 to 4 illustrate a preferred embodiment of the sealing lid of the packaging combination. This sealing lid 4 is designed to close the container 2 of the packaging combination where a product is stored in a seal-tight manner. The sealing lid 4 has an inner diameter corresponding to the outer diameter of the mouth 11 of the container and has sealing lid attachment structure on its inner surface. The sealing lid attachment structure is preferably at least partially complementary to the attachment mechanism of the container, so it can be fastened to the mouth 11 of the container in a seal-tight manner.

Figure 12:
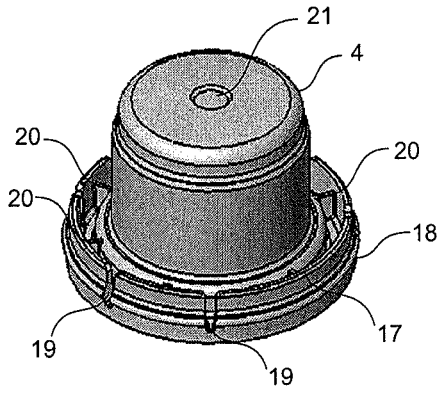
FIG. 12—perspective view of the sealing lid of the packaging combination of this present invention.
Figure 13:
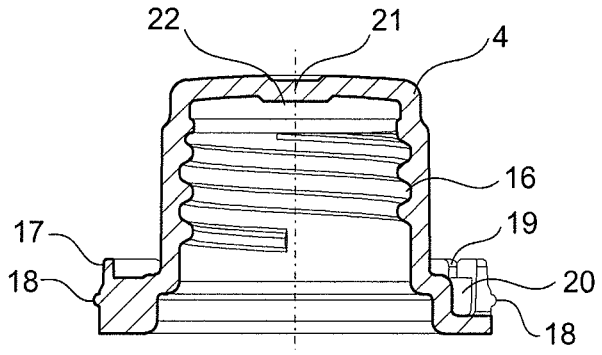
FIG. 13—cross section view of the sealing lid of the packaging combination of this present invention.
Figure 14:
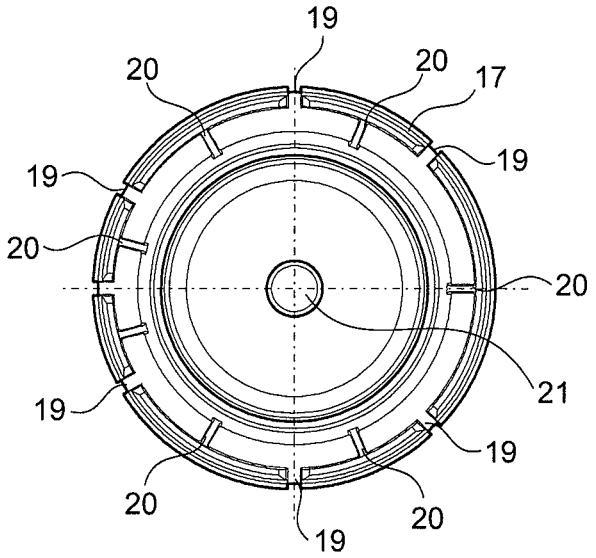
FIG. 14—top view of the sealing lid of the packaging combination of this present invention.

In a preferred embodiment of the invention illustrated in FIGS. 12 to 14, the sealing lid attachment structure is comprised of a peripheral thread guide 16, corresponding to the thread 12 of the neck 10 of the container, so that the sealing lid 4 can be screwed to the container.

In other alternative embodiments of the invention, the sealing lid attachment structure may comprise members fastened by pressure, or by lock due to shape, or by friction, or any combination thereof.

The sealing lid 4 has sealing lid fitting structure adapted to cooperate with the outer lid 3, forming an anti-rotative attachment between the two lids. The fitting structure provides for the sealing lid 4 to be fitted always in the same position with respect to the outer lid 3, so that the two lids are fastened together. Consequently, when this outer lid 3 is turned, the sealing lid 4 will turn as well.

In an embodiment of the invention illustrated in FIGS. 12 to 14, the lower end of the sealing lid 4 is folded outwards, forming a peripheral wing 17 with a portion that extends vertically.

In a preferred embodiment of the invention, the sealing lid fitting structure is at least partially located on the peripheral wing 17 of the sealing lid 4. According to the embodiment of the invention illustrated in FIGS. 12 to 14, the fitting structure of the sealing lid comprises an outer ring 18 formed on the outer face of the peripheral wing 17 and that encircles the entire sealing lid 4. This outer ring 18 is designed to fit into a corresponding ringed groove formed on the inner surface of the outer lid 3.

The sealing lid fitting structure also comprises a plurality of vertical slots 19 distributed around the peripheral wing 17 and which extend below the outer ring 18. Each of these slots connects to a rib on the inner wall of the outer lid 3. The distances between two neighboring slots are always different, to the extent that the sealing lid can be fastened to the outer lid 3 in only one specific position.

The sealing lid fitting means also comprise a plurality of "alettes" or upstanding tabs 20 located inside the fold that constitutes a peripheral wing 17 of the sealing lid 4. These tabs 20 extend from the inner face of the peripheral wing 17 to the outer surface of the sealing lid 4. As can be seen in FIGS. 12 and 14, each tab 20 is located equidistantly between two neighboring slots 19. These tabs 20 also guarantee that the sealing lid 4 is always fitted inside the outer lid 3 in the same position.

The sealing lid 4 may be made of a flexible material. In a preferred embodiment, the sealing lid is made of polypropylene. The sealing lid may also have structure to apportion the contents of the container 2. This sealing lid 4 can easily be perforated, so as to form an apportioning opening for the product stored inside the packaging. Alternatively, the sealing lid can take the shape of a spray-type appliance, or a powderizer for the product contained in the packaging, or any other apportioning structure that allows the sealing lid to seal the contents of the packaging.

The packaging combination may also have other apportioning structure coupled to the mouth 11 of the container 2, such as, for instance, a roll-on type deodorant appliance, a perforated lid, or any another apportioning structure that is unable to assure full sealing of the container. In such case, the apportioning structure is arranged between the sealing lid and the mouth 11 of the container, so that the container is sealed by the sealing lid.

Furthermore, in an alternative embodiment of the invention, the packaging combination, when used to store paste products, may comprise only a container 2, casing 1 and outer lid 3, wherein the attachment mechanism of the container 2 cooperates with the attachment structure (or threading connection) of the outer lid 3. In this case, the outer lid 3 must be configured in such a way that the mouth 11 of the container 2 is supported thereon when closed, providing the necessary seal-tightness. To guarantee this seal-tightness, the outer lid 3 can be provided with outer lid sealing structure (not shown) that may include flexible rubbers, special sealing profiles or similar known in the state of the art.

The packaging combination may have an additional sealing element applied to the mouth 11 of the container. In the embodiment of the invention illustrated in FIGS. 3 and 4, this additional sealing element consists of a protective film (not shown) placed on the mouth 11 of the container, being located between the inner surface of the sealing lid 4 and the mouth 11. This film may be made of a synthetic material such as expanded polyethylene, or any other suitable material. The film may also act as a kind of packaging seal so as to ensure that the container has not yet been opened.

As can be seen in FIGS. 1 and 3, the packaging combination may also have an outer lid 3 adapted to be fastened on the sealing lid 4. In a preferred embodiment illustrated in FIGS. 1 and 3, this outer lid 3 has an outer shape corresponding to the outer shape of the casing of the packaging combination. The outer lid 3 also has outer lid fitting structure adapted to cooperate with the sealing lid fitting structure. In the particular case illustrated in FIGS. 3 and 4, the outer lid fitting structure comprise a peripheral groove (not shown) located on the inner surface of the lower end of the outer lid 3. This groove is adapted to receive the outer ring 18 formed on the outer face of the peripheral wing 17 of the sealing lid 4.

The outer lid 3 may also have ribs on its inner surface, which connect to the slots 19 of the sealing lid 4. Accordingly, due to the variable spacing of the slots 19 around the sealing lid 4, said lid can only be fitted into the outer lid 3 in the specific position where the slots 19 and the ribs coincide.

Alternatively, the outer lid 3 can be fastened on the sealing lid 4 by means of a threading connection, or by friction fastening elements, or by lock due to shape, or by pressure, or any combination of these elements.

In a preferred embodiment of the invention, so that the container 2 is connected to the casing 1, it should be inserted through the lower opening of the casing, until its coupler is embedded in the casing coupler. Once these two parts are fitted together, the container attachment mechanism extends above the casing mouth 6.

Since the container does not need to traverse the casing mouth 6, it can have a larger cross section than the opening of the casing mouth 6. Thus, the container 2 may be shaped in such a way that it completely fills the inner area of the casing 1, maximizing the quantity of the product that can be stored inside the packaging.

Once the container 2 is inserted into the casing 1, the sealing lid 4 is secured on the container. Since the sealing lid 4 directly attaches onto the container 2 in a seal-tight manner, and this enables the container to be commercialized together with the sealing lid 2 in a secure manner, regardless of the other parts of the packaging combination. The protective film 23 may also be placed over the container in order to provide further assurance that the container is duly sealed.

The container combination described herein can be used to store cosmetic products such as liquid bases, cosmetic creams or moisturizers. Alternatively, this packaging may be used to store hygiene products such as shampoo, conditioner, liquid soap, deodorant or the like. Another application of this packaging combination can be to accommodate food products such as, for example, milk, yoghurt, fruit juices and the like.

Having described an example of preferred embodiment, it must be understood that the scope of this present invention encompasses other possible variations, and is only limited by the content of the claims, including possible equivalents.

What is claimed is:

1. A packaging combination comprising:

a casing having at least two openings, and a casing coupler;

a container having a mouth, a container coupler, and a container attachment mechanism, an outer surface of the container coupler comprising a first portion having an outer diameter greater than the diameter of the mouth such that the container is housed inside the casing and the container coupler cooperates with the casing coupler to secure the container within the casing, wherein the container is a refill that is removable from the casing for discarding and replacement by a new container, the container coupler further comprising two vertical protrusions which extend from a first portion of an outer surface of the container to a second portion of an inner surface of the casing, the protrusions being located diametrically opposite to each other and being configured to prevent the container from rotating about its axis inside the casing;

a sealing lid having sealing lid attachment structure, wherein the sealing lid is made of flexible material and is structured to be fastened to the container, with the sealing lid attachment structure cooperating with the container attachment mechanism, wherein the sealing lid has a peripheral wing at a lower end of the sealing lid, the sealing lid further comprising a plurality of vertical slots defined in the peripheral wing and having a variable spacing circumferentially about the sealing lid;

the sealing lid also comprising a plurality of upstanding tabs, wherein the upstanding tabs extend from an inner face of the peripheral wing to an outer surface of the sealing lid and each upstanding tab is located equidistantly between two neighboring vertical slots; and an outer lid structured to engage with and cover the sealing lid, wherein the vertical slots and the upstanding tabs in the sealing lid engage the outer lid such that the outer lid can be fastened to the sealing lid in only one specific position.

2. The packaging combination according to claim 1, wherein one opening of the casing constitutes a mouth of the casing and another opening of the casing constitutes a passage for inserting the container.

3. The packaging combination according to claim 2, wherein the cross section of the container is larger than the opening that constitutes the mouth of the casing.

4. The packaging combination according to claim 1, wherein the container is fitted inside the casing and the sealing lid is fixed onto the container.

5. The packaging combination according to claim 1, wherein the casing coupler is located on an inner surface of the casing.

6. The packaging combination according to claim 5, wherein the container attachment mechanism is located on the outer surface of the container.

7. The packaging combination according to claim 6, wherein the container coupler is located on the outer surface of the container, below the container attachment mechanism.

8. The packaging combination according to claim 1, wherein the container coupler is detachably fastened to the casing coupler.

9. The packaging combination according to claim 8, wherein the container coupler cooperates with the casing coupler by pressure-fastening.

10. The packaging combination according to claim 8, wherein the container coupler cooperates with the casing coupler by shape-locking.

11. The packaging combination according to claim 8, wherein the container coupler cooperates with the casing coupler by a threaded connection.

12. The packaging combination according to claim 1, wherein the sealing lid attachment structure cooperates with the container attachment mechanism by pressure fastening.

13. The packaging combination according to claim 1, wherein the sealing lid attachment structure cooperates with the container attachment mechanism by shape-locking.

14. The packaging combination according to claim 1, wherein the sealing lid attachment structure cooperates with the container attachment mechanism by a threaded connection.

15. The packaging combination according to claim 1, wherein the sealing lid is made of polypropylene.

16. The packaging combination according to claim 1, wherein the sealing lid has apportioning structure for the contents of the container.

* * * * *